US010341756B2

(12) United States Patent
Yeung et al.

(10) Patent No.: US 10,341,756 B2
(45) Date of Patent: Jul. 2, 2019

(54) PURE WIRELESS EARPHONES USING OPTIMAL MONOPOLE ANTENNAE

(71) Applicant: Fujikon Industrial Co., Ltd, Hong Kong (CN)

(72) Inventors: Siu Chung Yeung, Hong Kong (CN); Man Tai Lam, Hong Kong (CN); Kit Bun Chan, Hong Kong (CN)

(73) Assignee: Fujikon Industrial Co., Ltd, Hong Kong (CN)

( * ) Notice: Subject to any disclaimer, the term of this patent is extended or adjusted under 35 U.S.C. 154(b) by 0 days.

(21) Appl. No.: 15/446,055

(22) Filed: Mar. 1, 2017

(65) Prior Publication Data

US 2017/0295420 A1 Oct. 12, 2017

(30) Foreign Application Priority Data

Apr. 11, 2016 (CN) ..... 2016 1 0219720

(51) Int. Cl.
*H04R 1/10* (2006.01)
*H01Q 1/27* (2006.01)
(Continued)

(52) U.S. Cl.
CPC ..... *H04R 1/1016* (2013.01); *H01Q 1/243* (2013.01); *H01Q 1/273* (2013.01); *H01Q 3/02* (2013.01); *H01Q 9/30* (2013.01); *H04R 1/1025* (2013.01); *H04R 1/1075* (2013.01); *H04R 5/033* (2013.01); *H04R 2420/07* (2013.01); *H04R 2420/09* (2013.01)

(58) Field of Classification Search
CPC .. H04R 1/1016; H04R 1/1025; H04R 1/1075; H04R 5/033
See application file for complete search history.

(56) References Cited

U.S. PATENT DOCUMENTS

2017/0180844 A1* 6/2017 Nanni ..... H04W 76/10
2017/0359645 A1* 12/2017 Chen ..... H04B 1/385

* cited by examiner

*Primary Examiner* — Sunita Joshi
(74) *Attorney, Agent, or Firm* — Luoh J. Wu; Continent Patent Office LLP

(57) ABSTRACT

The present invention relates to a pair of pure wireless earphones using optimal monopole antennae in the technical field of communications, comprising in-ear type earphone housings and RF signal generation devices disposed in the in-ear type earphone housings, wherein positioning stages matched with the shape of auricular concha cavities are at the tops of bottom housings; each RF signal generation device consists of an antenna, a main PCB and a battery; each antenna is used for establishing an RF communication link with an audio source and a secondary earpiece; and a ball is drawn with each antenna as a center point and the outer wall of the corresponding in-ear type earphone housing closest to the antenna as a radius to form a space as an antenna holding area in which the antenna is located, and the radius of the ball is greater than 4 mm. When a distance between each antenna and the skin or tissues of a human body is greater than 4 mm, an optimal coupling can be formed therebetween to possibly create an optimal RF creeping wave communication link, the antenna gain and efficiency attenuation of an in-ear type Bluetooth device is within an acceptable range, and the antenna can also maintain a proper RF communication link between a primary earpiece and a mobile phone.

6 Claims, 6 Drawing Sheets

(51) Int. Cl.

| | |
|---|---|
| ***H01Q 9/30*** | (2006.01) |
| ***H01Q 1/24*** | (2006.01) |
| ***H01Q 3/02*** | (2006.01) |
| ***H04R 5/033*** | (2006.01) |

PURE WIRELESS EARPHONES USING OPTIMAL MONOPOLE ANTENNAE

This application claims the benefit of China Patent application number 201610219720.6 filed on Apr. 11, 2016. The content of this document and the entire disclosure of publications, patents, and patent documents mentioned herein are incorporated by reference.

BACKGROUND OF THE INVENTION

Technical Field

The present invention relates to the technical field of communications, in particular to a pair of earphones, and in more particular to a pair of pure wireless earphones using optimal monopole antennae.

Description of Related Art

At present, most of common wireless earphones are equipped with only one RF transceiver for maintaining the wireless communication between the earphones and an audio source (such as a mobile phone). Pure wireless earphones refer to an earphone pair in which no electric wire is needed for the connection between left and right earpieces, and instead, another wireless communication channel is employed for synchronizing the stereo audio playing between the left and right earpieces. To build a pair of pure wireless earphones, the left and right earpieces need to be equipped with a special wireless transceiver respectively. Apparently, a Bluetooth wireless communication standard can be employed as a more appropriate solution, and when two sides of a pair of pure wireless earphones are respectively equipped with a wireless transceiver (2 in total), it means that two Bluetooth links are needed, i.e. 1) a primary communication link between each earpiece and an audio source; and b) a secondary communication link between the left and right earpieces. A "master-slave" configuration is typically employed between the left and right earpieces for a pair of pure wireless earphones, the master earpiece is used for processing the communication link with the audio source (such as the mobile phone), and meanwhile, the other Bluetooth signal channel is employed to forward an audio signal to the slave earpiece.

For wireless signals capable of penetrating through a human body, signal losses caused by human tissues are compensated for with a near field magnetic induction (NFMI) technology or by reinforcing the intensity of the RF signals. A relevant principle is as follows: the human tissues are capable of absorbing or highly attenuating the RF signals, and NFMI facilitates the smooth penetration through the human tissues by substituting electromagnetic (EM) waves with a magnetic field.

According to this, to ensure the normal communication between the left and right earpieces, the antenna can be placed away from the human skin to reduce the human body attenuation effect as much as possible. In addition, an antenna having a large size can be employed to likewise improve the RF transmission efficiency to thereby cancel the signal attenuation caused by a human body. With the above two solutions, a product with a shape suitable for being worn in the auricle cannot be produced. At present, one of the common methods for manufacturing a pure wireless product is to increase the size of the housings of the product and configuring electronic elements inside the housings, instead of disposing the product near the auricle. However, the product with the larger size is inconsistent with the current trend of miniaturization, and it is impossible to ensure that the product has a lightweight shape applicable to an in-ear type application.

Another solution for manufacturing a pair of pure wireless earphones employs an ear-hook type design, and according to this, a designer may place an antenna in a hook. With this method, it is easy to separate the antenna from the human skin, and similarly, this is also not suitable for the in-ear type earphone application.

BRIEF SUMMARY OF THE INVENTION

An object of the present invention is to overcome the defects described above and provide a pair of pure wireless earphones using optimal monopole antennae. The optimal monopole antennae can establish a proper RF communication link between the "main-slave" in-ear type earpieces worn on the head, and meanwhile, can also maintain an appropriate RF communication link between the master earpiece and a mobile phone, and the optimal monopole antennae are suitable for creating an RF communication link and implementing the coupling between RF creeping waves and human skin, thereby ensuring that the antenna has the characteristic of omni-directional radiation.

With a reasonable design, the antennae are capable of controlling and transceiving RF signals, and act as key components for the primary link between the master earpiece and the mobile phone and a link between the master and slave earpieces.

A large number of research shows that RF waves can be transmitted to different body parts through a skin surface, and based on this fact, a conclusion can be drawn as follows: the RF waves need no media (such as a human body) for linear transmission, and as an alternative, may be transmitted along a curved surface of a human body. Such RF transmission on the skin surface of the human body is called "RF creeping waves", and both the RF waves coupled to the human skin and an antenna radiation pattern will have an effect on the capability of generating the RF creeping waves.

Since the RF transmission power is limited by a Bluetooth chipset, the method for "generating stronger RF creeping waves by reinforcing the RF output power" is undesirable. In the meantime, higher power may also lead to higher power consumption and is not suitable for portable devices, and especially an in-ear type earphone application which is limited in the battery capacity. Therefore, the shortest communication distance between a "left ear" and a "right ear" is between the back faces of the auricles, and according to this, it is an optimal option to generate the RF creeping waves on the back faces of the auricles.

The object of the present invention is achieved in a manner as follows:

a pair of pure wireless earphones using optimal monopole antennae comprises in-ear type earphone housings and RF signal generation devices disposed in the in-ear type earphone housings; the in-ear type earphone housings are formed by buckling top housings and bottom housings in pairs and internally provided with accommodating cavities; the bottoms of the bottom housings extend downwards and are sound outlets communicated with the accommodating cavities; the bottom housings are internally provided with loudspeakers communicated with the sound outlets and sleeved with ear pads for plugging external acoustic foramina, at the bottoms; positioning stages matched with the shapes of auricular concha cavities are at the tops of the bottom housings; the outer bottom faces of the positioning stages fit the surfaces of the auricular concha cavities in pairs; the outer walls of the positioning stages are in contact with the tragi; the RF signal generation devices are located in the accommodating cavities; each RF signal generation device consists of an antenna, a main PCB and a battery; each main PCB comprises a Bluetooth chipset; each antenna is used for establishing RF communication links with an audio source and a secondary earpiece; the batteries, the antennae and the loudspeakers are electrically connected with the main PCBs; and a ball is drawn with each antenna as a center point and the outer wall of the corresponding in-ear type earphone housing closest to the antenna as a radius to form a space as an antenna holding area in which the antenna is located, and the radius of the ball is greater than 4 mm; since the in-ear type earphone housings are closely pressed to the auricular concha cavities and the tragi of the human body, the radius of the ball is a distance between the antenna and the skin or tissue of the human body; and when the radius of the ball is greater than 4 mm, that is to say the distance between the antenna and the skin or tissue of the human body is greater than 4 mm.

In the description above, as a preferred solution, an optimal coupling limit between the antenna and the skin or tissues of the human body is 4 mm, and when the distance is 4 mm, an optimal antenna center is created and also acts as an antenna feedback point.

RF signals may penetrate through the thinnest auricle areas near the earholes and auricular concha cavities of the human skull, couple to the skin near the back faces of the auricles, and then perform connection through an optimal RF creeping wave route.

Antenna impedance, radiation patterns, efficiency and other aspects may be affected by the human tissues, therefore, if the distance between each antenna and the skin or tissues of the human body is too short, a human body effect will affect the RF transmission efficiency and the antenna gain, and then directly affect the wireless work ranges of the RF communication links and the product, and in addition, the antenna gain and efficiency attenuation caused by the human body effect will also affect the RF waves coupled to the human body. It is found that if an antenna spacing is greater than 4 mm, it is suitable for implementing the coupling between RF as well as RF creeping waves and the human skin.

In the description above, as a preferred solution, the main PCBs are provided with vertically disposed metal grounding layers, which evenly surround the edges of the main PCBs and are used for ensuring the even distribution of radio-frequency radiation currents.

Since the in-ear type earphone housings need to be provided with the positioning stages in contact with the auricular concha cavities, this also limits the size of the main PCBs, and the width of each auricular concha cavity is less than ¼ of the wavelength (about 30 mm) of a Bluetooth signal, which means that each main PCB is to be less than ¼ wavelength; due to the limitation from the size of the main PCBs, the radiation mode and efficiency of the antenna are deteriorated in a more all-round way; in most cases, each main PCB has a main form of very thin electric grounding radiation-frequency radiation, and this small electric grounding solution leads to the reduction of the antenna efficiency; to cancel the ground size deterioration, the metal grounding layers may compensate for this adverse influence, this is because a thicker metal grounding layer may reduce the internal resistance of an electric grinding project, the entire assembly comprises the main PCBs and batteries to form a thicker electric grounding solution, this whole metal grounding layer in which the batteries are connected with the PCBs may increase the gain and antenna radiation of the antennae and increase the efficiency to allow the radio-frequency radiation to be more omni-directional, which is the key point for radiation-frequency transmitting and receiving.

In the description above, as a preferred solution, the metal grounding layers are made of a copper foil material.

In the description above, as a preferred solution, the batteries are disposed at the bottom faces of the main PCBs, the metal grounding layers surround the batteries, and the edges of the main PCBs are provided with USB end plates for charging the batteries.

In general, when an audio source is away from or close to a user (for example, located in respective pocket of a user clothing), it is necessary for the wireless earphones to have the efficient and sensitive capability for communication transmitting and receiving.

In the description above, as a preferred solution, the antennae are short monopole antennae, which are suitable for the appropriate radiation characteristic of an earphone application, and to meet this requirement, it is necessary to ensure that the antennae have the omni-directional radiation characteristic.

In the description above, as a preferred solution, the short monopole antennae are short spiral monopole antennae, which are most suitable for the antenna holding areas.

In the description above, as a preferred solution, the short monopole antennae are balanced type antenna; a large amount of research results show that under the condition of the same human skin spacing, the balanced type antennae are less susceptible to the human tissues compared with non-balanced type antennae, the balanced type antennae are more suitable for pure wireless earphone applications since they are less susceptible to the human body, however, product housings need to be large enough to accommodate such antennae.

The present invention has the following advantageous effects:

1) when the radius of the ball is equal to 4 mm, that is to say the distance between each antenna and the skin or tissue of the human body is equal to 4 mm, the top of the antenna is the optimal antenna feedback point, and all design criteria are met thereby to possibly ensure the implementation of the generation of the optimal RF creeping waves and the establishment of a secure RF link with the audio source (such as a smart phone);
2) when the distance between each antenna and the skin or tissue of the human body is greater than 4 mm, the antenna gain and efficiency attenuation of an in-ear type Bluetooth device is within an acceptable range under this spacing condition, and the antenna can also maintain a proper RF communication link between a primary earpiece and a mobile phone;
3) when the spacing between each antenna and the human skin is 4 mm, an optimal coupling can be formed with the human skin, and an optimal RF creeping wave communication link can be generated between the left and right earphone devices; and
4) the auricles and the auricular concha cavities are unique recess areas allowing the placement of the in-ear type earphones, and meanwhile, as the thinnest human tissues near the earholes and back faces of the ears of a human, the auricles and the auricular concha cavities allow the RF waves to penetrate through the auricles and generate the RF creeping waves on the back faces of the ears.

BRIEF DESCRIPTION OF THE SEVERAL VIEWS OF THE DRAWINGS

In FIG. 3, bidirectional arrows refer to mounting and connection directions of respective parts and components, and in FIG. 6, a dash line refers to an analog radiation pattern and a solid line refers to an actually measured radiation pattern; and In FIG. 1 to FIG. 5, reference signs are as follows: 1. bottom housing, 2. top housing, 3. sound outlet, 4. positioning stage, 5. antenna, 6. main PCB, 7. loudspeaker, 8. battery, 9. ear pad, 10. USB end plate, 11. metal grounding layer, 12, human head, 13. RF creeping wave, and 14. RF communication link.

DETAILED DESCRIPTION OF THE INVENTION

The present invention will be further described in details below in combination with the accompanying drawings and particular embodiments.

Figure 1:
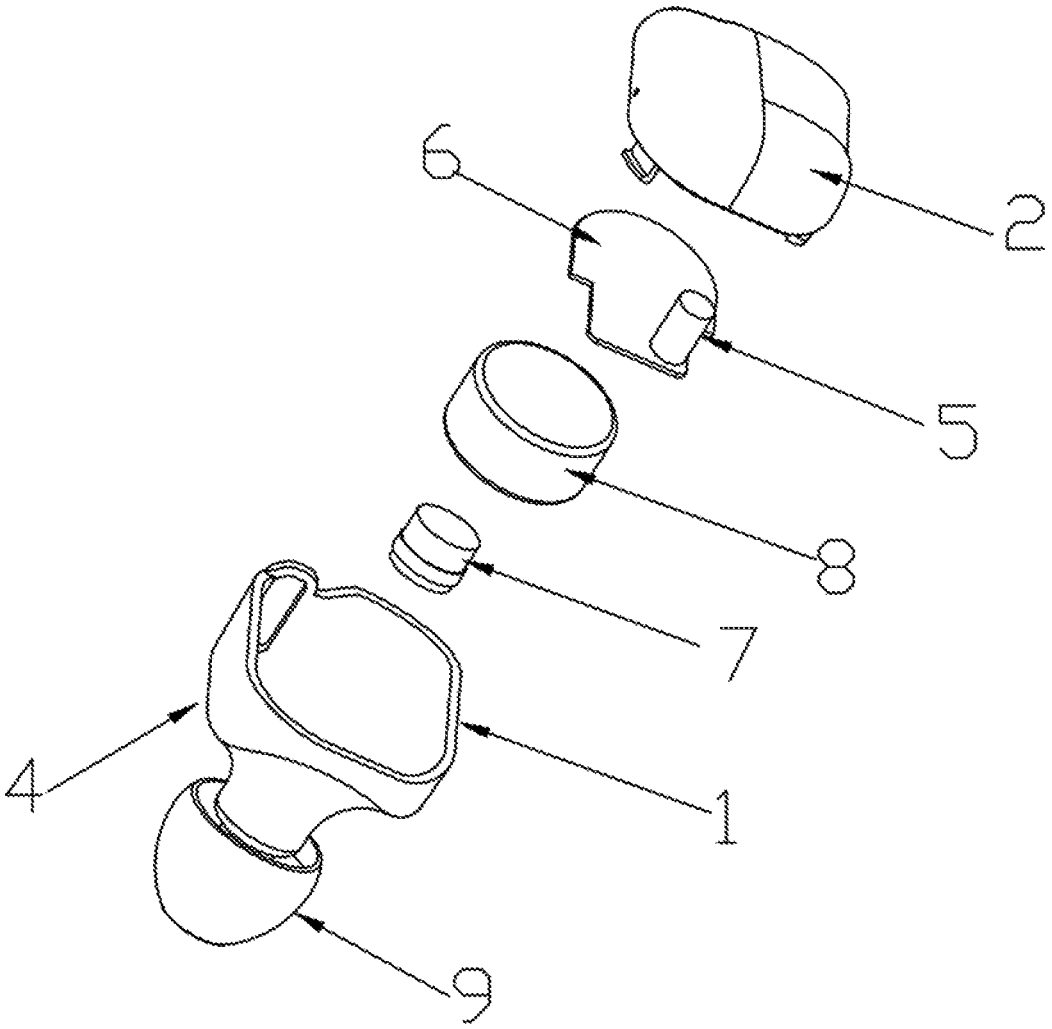
FIG. 1 is an exploded schematic diagram of a structure according to an embodiment of the present invention.
Figure 2:
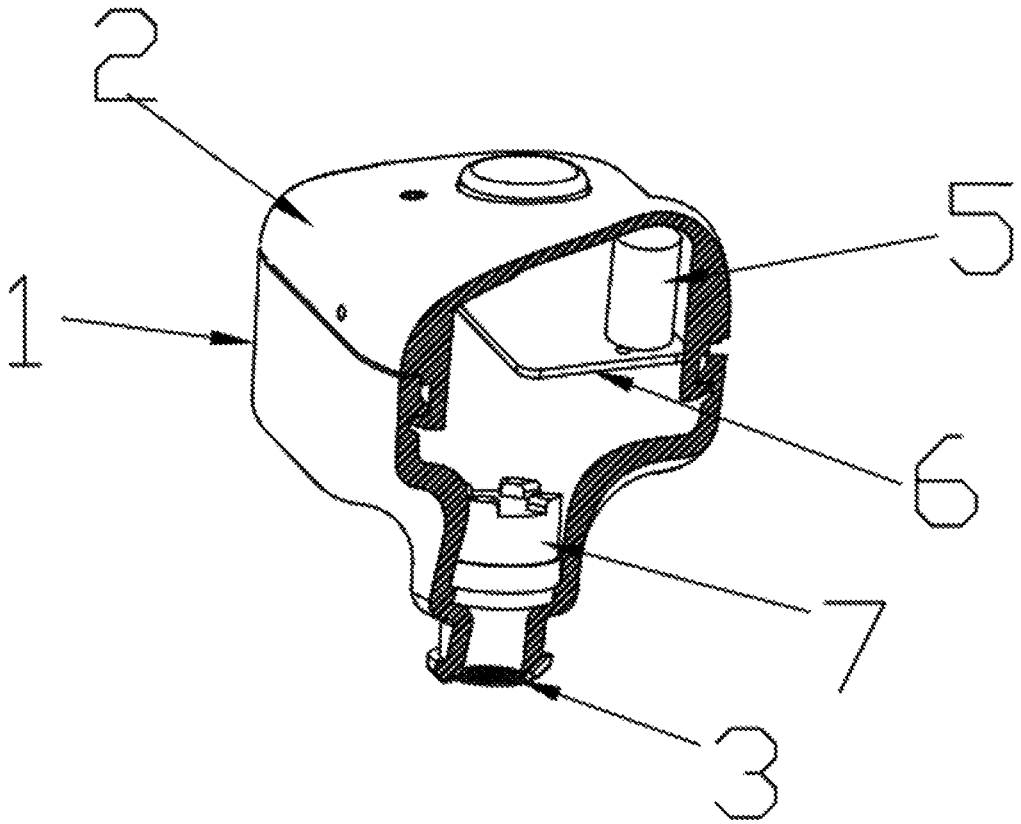
FIG. 2 is a sectional view of an embodiment of the present invention.
Figure 3:
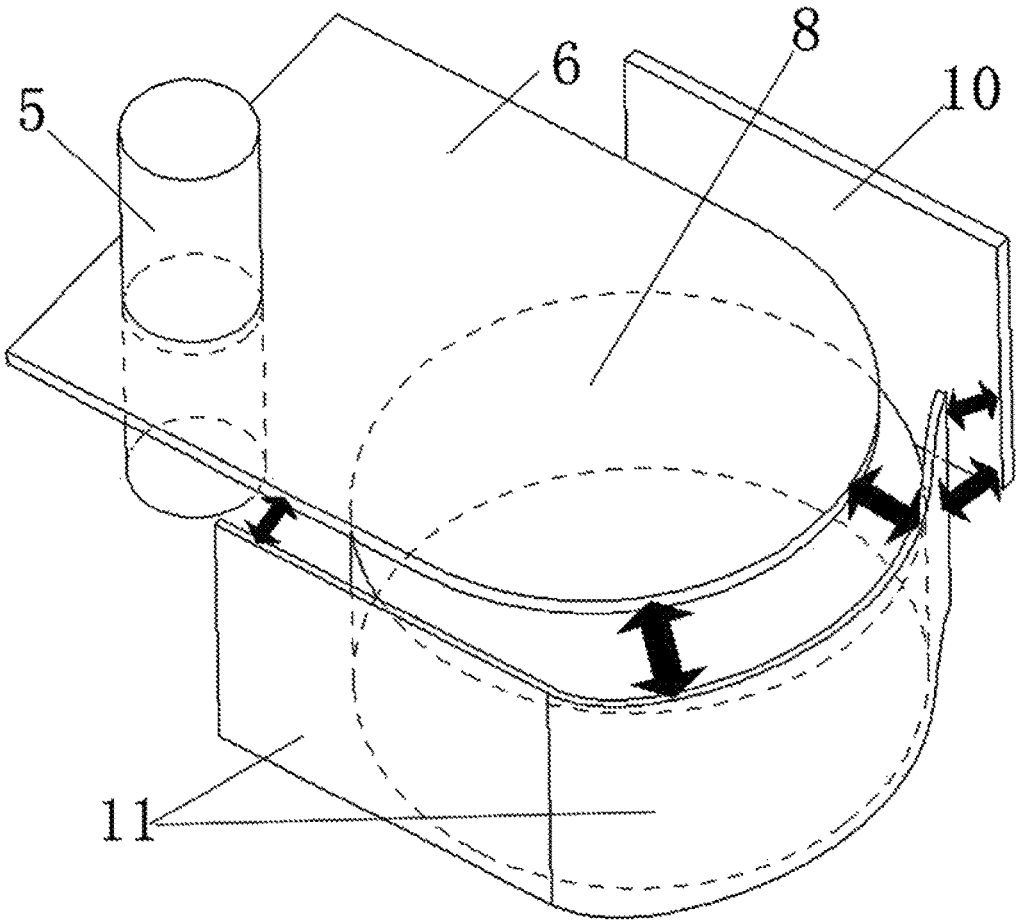
FIG. 3 is a schematic diagram of a stereoscopic structure of an RF signal generation device in an embodiment of the present invention.

In the present embodiment, with reference to FIG. 1 to FIG. 6, a pair of pure wireless earphones using optimal monopole antennae according to specific implementation comprises in-ear type earphone housings and RF signal generation devices disposed in the in-ear type earphone housings, and as shown in FIG. 1 and FIG. 3, the in-ear type earphone housings are formed by buckling top housings 2 and bottom housings 1 in pair. The in-ear type earphone housings are internally provided with accommodating cavities, the bottoms of the bottom housings 1 extend downwards and are sound outlets 3 communicated with the accommodating cavities, the bottom housings 1 are internally provided with loudspeakers 7 communicated with the sound outlets 3 and sleeved with ear pads 9 for plugging external acoustic foramina, at bottoms.

Positioning stages 4 matched with the shape of auricular concha cavities are at the tops of the bottom housings 1; the outer bottom faces of the positioning stages 4 fit the surfaces of the auricular concha cavities in pairs; the outer walls of the positioning stages 4 are in contact with the tragi; the RF signal generation devices are located in the accommodating cavities; each RF signal generation device consists of an antenna 5, a main PCB 6 and a battery 8; the antennae 5 in the present embodiment are short spiral monopole antennae; each main PCB 6 comprises a Bluetooth chipset, and each main PCB 6 in the present embodiment is horizontally disposed in the corresponding accommodating cavity; the antennae 5 are used for establishing RF communication links 14 with an audio source and an antenna 5 of a secondary earpiece; the batteries 8, the antennae 5 and the loudspeakers 7 are electrically connected with the main PCBs 6.

A ball is drawn with each antenna 5 as a center point and the outer wall of the corresponding in-ear type earphone housing closest to the antenna 5 as a radius to form a space as an area for holding the antenna 5 which is placed in the area for holding the antenna 5, and the radius of the ball is greater than 4 mm; since the in-ear type earphone housings are closely pressed to the auricular concha cavities and the tragi of the human body, the radius of the ball is a distance between the antenna 5 and the skin or tissue of a human body; when the radius of the ball is greater than 4 mm, that is to say the distance between the antenna 5 and the skin or tissue of the human body is greater than 4 mm, and if the spacing between the antenna 5 and the skin or tissue of the human body is greater than 4 mm, it is suitable for enabling the coupling between RF as well as RF creeping waves 13 and the human skin.

As shown in FIG. 3, the main PCBs 6 are provided with vertically disposed metal grounding layers 11, which evenly surround the edges of the main PCBs 6 and are used for ensuring the event distribution of the radio-frequency radiation currents; the metal grounding layers are formed by welding copper foil materials; the batteries 8 are disposed on the bottom faces of the main PCBs 6; the metal grounding layers 11 surround the respective batteries 8; and the edges of the main PCBs 6 are provided with USB end plates 10 for charging the batteries 8.

When the radius of the ball is equal to 4 mm, that is to say the distance between the antenna 5 and the skin or tissue of the human body is equal to 4 mm, the top of the antenna 5 is the optimal antenna feedback point, and all design criteria are met thereby to possibly ensure the implementation of the generation of the optimal RF creeping waves 13 and the establishment of a secure RF link with the audio source (such as a smart phone); when a distance between the antenna 5 and the skin or tissue of the human body is greater than 4 mm, the gain and efficiency attenuation of the antennae 5 of an in-ear type Bluetooth device are within an acceptable range under this spacing condition, and the antennae 5 can also maintain a proper RF communication link 14 between a master earpiece and a mobile phone; when a spacing between the antenna 5 and the human skin is 4 mm, an optimal coupling can be formed with the human skin, and the communication link of the optimal RF creeping wave 13 can be created between the left and right earphone devices; and the auricles and the auricular concha cavities are unique recess areas allowing the placement of the in-ear type earphones, and meanwhile, as the thinnest human tissues near the earholes and back faces of the ears of a human, the auricles and the auricular concha cavities allow the RF waves to penetrate through the auricles and generate the RF creeping waves 13 on the back faces of the ears.

Figure 4:
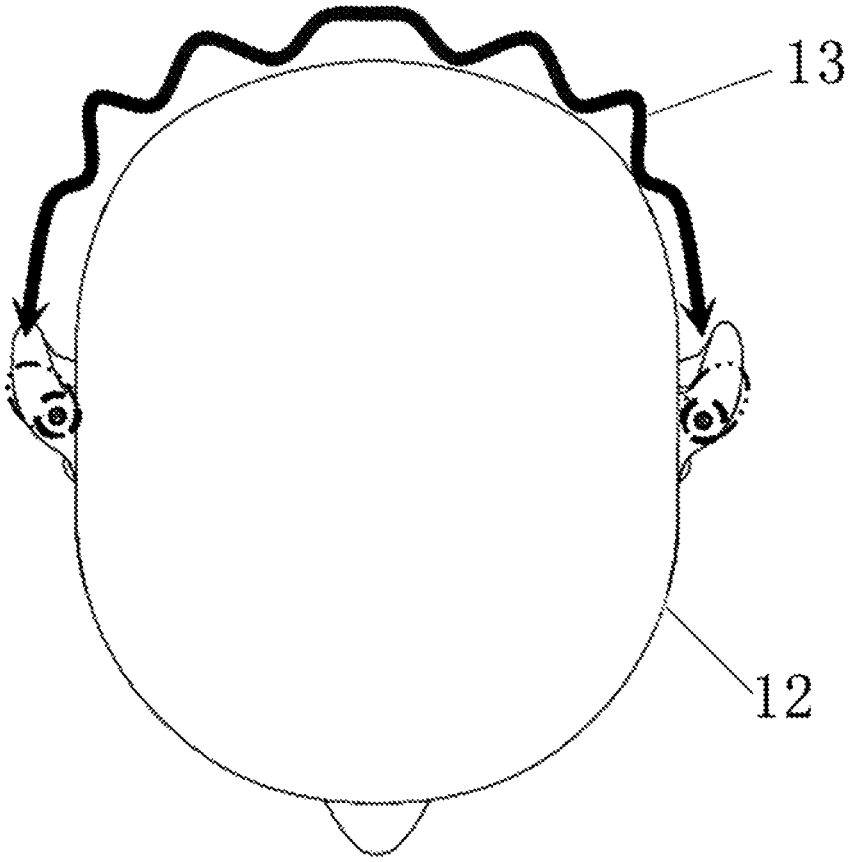
FIG. 4 is a basic concept diagram of RF creeping waves in an embodiment of the present invention.

As shown in FIG. 4, the shortest communication distance between a "left ear" and a "right ear" is between the back faces of the auricles, and it is an optimal option to generate the RF creeping waves 13 between the back faces of the auricles of a human head 12; RF signals may penetrate through the thinnest auricle areas near the earholes and auricular concha cavities of a human skull; and as the thinnest human tissues near the earholes and back faces of the ears of the human body, these areas allow the RF waves to penetrate through the auricles and couple to the skin near the back faces of auricles at the optimal positions behind the ears at which the RF creeping waves 13 are generated.

Figure 5:
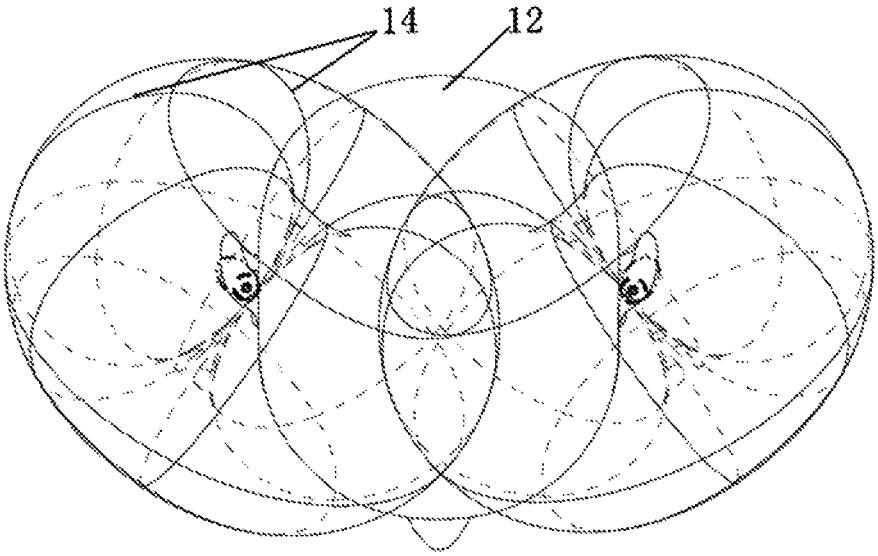
FIG. 5 is a diagram showing the working principle of 3D antenna radiation in an embodiment of the present invention.

As shown in FIG. 5, it shows how the EM waves radiate, how the EM waves penetrate through the auricles of the human head 12 to be coupled with the human skin at the back faces of the auricles, and how the EM waves form the RF communication link 14 between the left and right earpieces.

Figure 6:
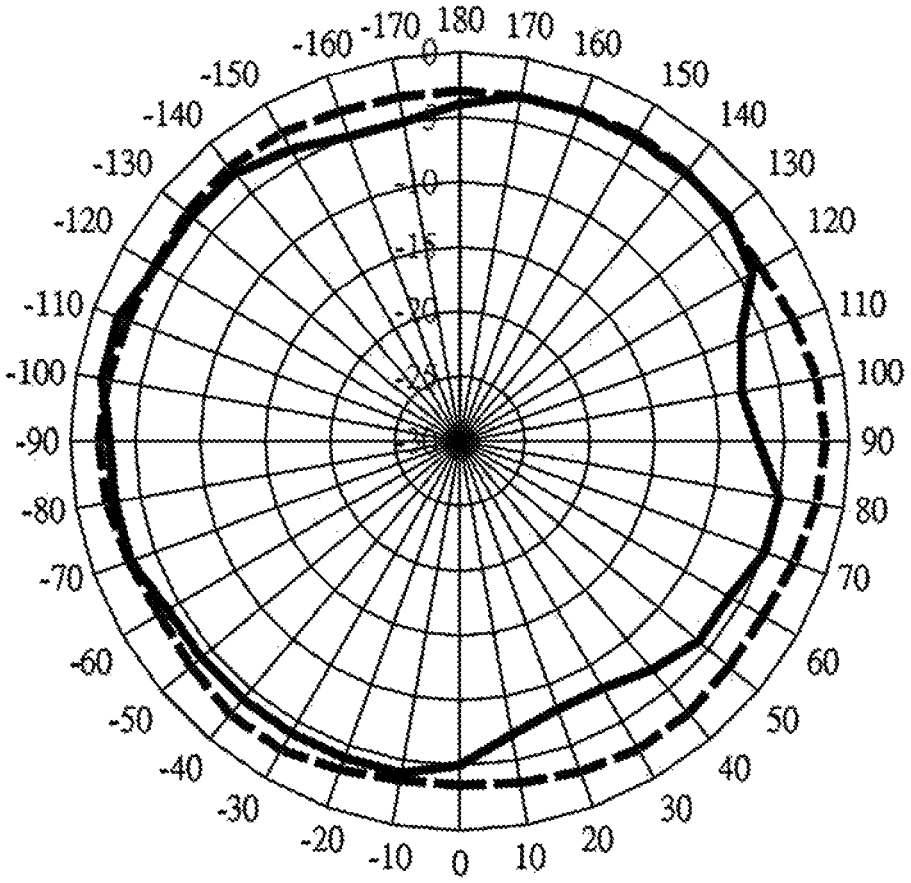
FIG. 6 is an "X-Z" plane 2D curve diagram of analog and actual antenna radiation patterns in an embodiment of the present invention.

As shown in FIG. 6, the results from the analog and actual radiation patterns show that the two radiation patterns are almost fitted, meanwhile, this also proves that the design goal of transceiving the RF waves between the "mater-slave" earpieces and the audio sources can be achieved.

The above is the further detailed illustration made for the present invention in combination with particular preferred embodiments, and cannot be deemed as the particular implementation of the present invention is limited to these illustrations. For those of ordinary skills in the art to which the present invention pertains, a plurality of simple deduction or substitutions, which can also be made without departing from the concept of the present invention, are construed to fall within the protection scope of the present invention.

What is claimed is:

1. A pair of pure wireless earphones using optimal monopole antennae, comprising in-ear type earphone housings and RF signal generation devices disposed in the in-ear type earphone housings, the in-ear type earphone housings being formed by buckling top housings and bottom housings in pairs and being internally provided with accommodating cavities, the bottoms of the bottom housings extending downwards and being sound outlets communicated with the accommodating cavities, the bottom housings being internally provided with loudspeakers communicated with the sound outlets and being sleeved with ear pads for plugging external acoustic foramina at the bottoms, characterized in that positioning stages matched with the shape of auricular concha cavities are at the tops of the bottom housings; the outer bottom faces of the positioning stages fit the surfaces of the auricular concha cavities in pairs; the outer walls of the positioning stages are in contact with tragi; the RF signal generation devices are located in the accommodating cavities; each RF signal generation device consists of an antenna, a main PCB and a battery; each main PCB comprises a Bluetooth chipset; each antenna is used for establishing RF communication links with an audio source and a secondary earpiece; each battery, each antenna and each loudspeaker are electrically connected with the corresponding main PCB; and a ball is drawn with each antenna as a center point and the outer wall of the corresponding in-ear type earphone housing closest to the antenna as a radius to form a space as an antenna holding area in which the antenna is located, and the radius of the ball is greater than 4 mm; wherein the main PCBs are provided with vertically disposed metal grounding layers, which evenly surround the edges of the main PCBs and are used for ensuring the even distribution of radio-frequency radiation currents.

2. The pair of pure wireless earphones using the optimal monopole antennae according to claim 1, characterized in that the metal grounding layers are made of a copper foil material.

3. The pair of pure wireless earphones using the optimal monopole antennae according to claim 1, characterized in that the batteries are disposed at the bottom faces of the main PCBs, the metal grounding layers surround the batteries, and the edges of the main PCBs are provided with USB end plates for charging the batteries.

4. The pair of pure wireless earphones using the optimal monopole antennae according to anyone of claim 1, characterized in that the antennae are short monopole antennae.

5. The pair of pure wireless earphones using the optimal monopole antennae according to claim 4, characterized in that the short monopole antennae are short spiral monopole antennae.

6. The pair of pure wireless earphones using the optimal monopole antennae according to claim 4, characterized in that the short monopole antennae are balanced type antennae.

* * * * *